United States Patent [19]

Raasch

[11] 4,406,418

[45] Sep. 27, 1983

[54] DRIVE ROLLER

[75] Inventor: Hans Raasch, Monchen-Gladbach, Fed. Rep. of Germany

[73] Assignee: W. Schlafhorst & Co., Mönchengladbach, Fed. Rep. of Germany

[21] Appl. No.: 254,645

[22] Filed: Apr. 16, 1981

[30] Foreign Application Priority Data

Apr. 19, 1980 [DE] Fed. Rep. of Germany ..... 3015207

[51] Int. Cl.[3] ..... B65H 54/46

[52] U.S. Cl. ..... 242/18 DD; 29/110

[58] Field of Search ..... 242/18 DD; 29/110, 120, 29/125, 130

[56] References Cited

FOREIGN PATENT DOCUMENTS 1144163 2/1963 Fed. Rep. of Germany ... 242/18 DD 2449242 4/1976 Fed. Rep. of Germany ... 242/18 DD 2720935 11/1978 Fed. Rep. of Germany .. 242/18 DD

*Primary Examiner*—Stanley N. Gilreath

*Attorney, Agent, or Firm*—Herbert L. Lerner; Laurence A. Greenberg

[57] ABSTRACT

Drive roller for winding a textile spool, including a drive-roller-body having a middle part and two side parts, and two removable, separable, annular drive linings with high friction properties, one of the drive linings being clamped to each end of the drive-roller-body, and each of the drive linings having a shape being matched to the shape of at least the middle part of the drive-roller-body.

4 Claims, 2 Drawing Figures

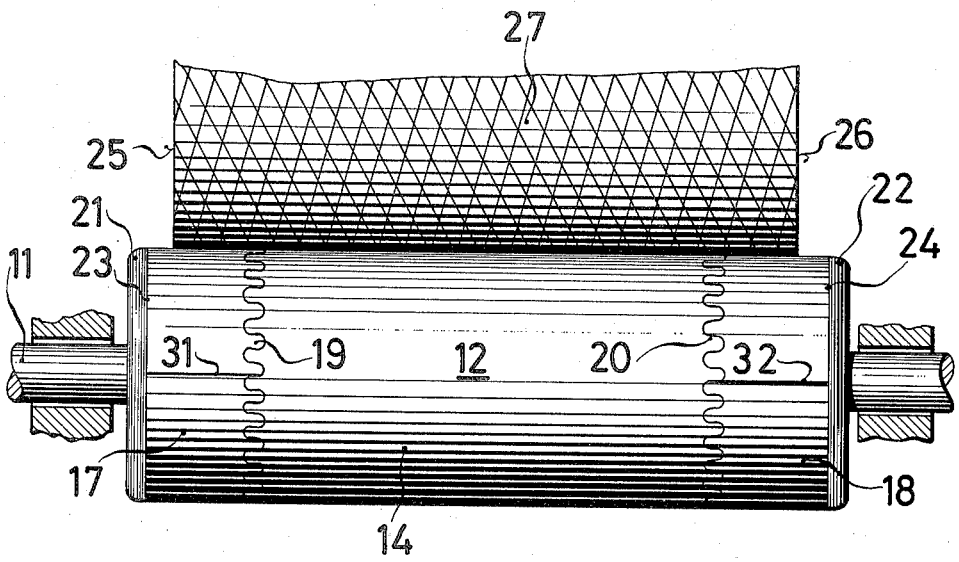
FIG. 2
FIG. 1
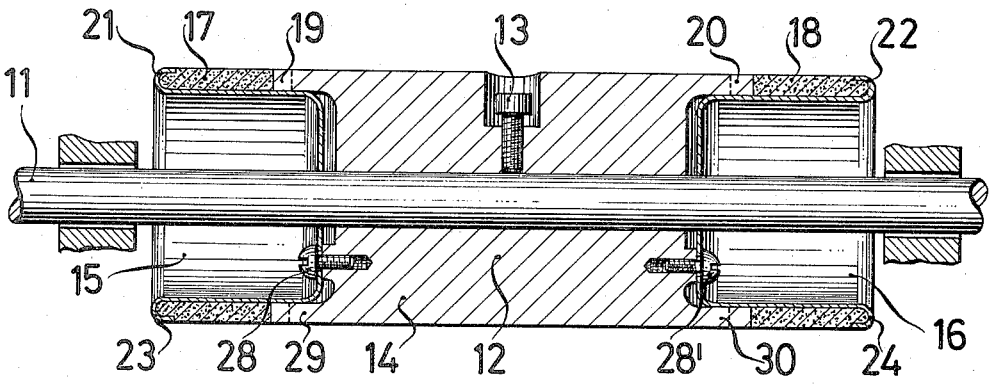

DRIVE ROLLER

The invention relates to a drive roller for winding a textile spool including a drive-roller-body having a plurality of parts and a removable, separable, ring-shaped drive lining with high friction properties which is form-fittingly clamped to the drive-roller-body.

The device described in co-pending application Ser. No. 903,615, filed May 8, 1978, has already mentioned the objective of preventing the formation of waste on the roller and of simultaneously to replace a worn drive lining without pulling the drive-roller-body and the central shaft from the machine.

During the winding of large cylindrical cheeses, great difficulties arise if the drive lining or coating is only provided in the middle of a drive roller. Cylindrical cheeses with a large volume have a more compact construction at their ends, so that the drive roller has a tendency to slip as the fullness of the spool increases.

It is accordingly an object of the invention to provide a drive roller which overcomes the hereinafore-mentioned disadvantages of the heretofore-known devices of this general type, and to do so in such manner that even spools with a large volume, especially cylindrical textile spools can be wound with perfect quality. The formation of accumulated waste on the roller is therefore to be prevented as it is in the above-mentioned co-pending application, and at the same time it should be possible to exchange a worn drive lining without having to remove the drive roller body or the central shaft, for the machine.

With the foregoing and other objects in view there is provided, in accordance with the invention, a drive roller for winding a textile spool, comprising a drive-roller-body having a middle part and two side parts, and two removable, separable, annular drive linings with high friction properties, one of the drive linings being clamped to each end of the drive-roller-body or drive roller, and each of the drive linings having a shape being matched or formfittingly clamped to the shape of at least the middle part of the drive-roller-body.

Through the use of this construction of the drive roller, the exchange of the drive lining can be performed as simply and readily as before. However, the winding of satisfactorily larger spools is simultaneously also made possible by the fact that the drive linings lie under the spool ends, where the spool is especially compactly constructed. A slipping of the drive roller is therefore no longer possible, even with spools having a large volume.

In accordance with another feature of the invention, the drive linings and middle part have a radially directed serrated parting joint formed therebetween.

In accordance with a further feature of the invention, each of the side parts overlaps the associated one of the drive linings at the parting joints.

In accordance with an added feature of the invention, the side parts and drive linings have separating gaps formed therebetween beyond the edge of the textile spool to be wound.

In accordance with a concomitant feature of the invention, the side parts are in the form of pot-shaped, drawn sheetmetal parts being extended to or reaching to the middle part, and including a rolled edge or bead integral with each side part, each edge being in contact with one of the drive linings.

By constructing the side parts of the drive-roller-body as pot-shaped, drawn sheet metal parts, material weight is saved, and the mass of the rotating parts is reduced. A further advantage of the invention is that due to the doubling of drive-linings, their wear does not reduce their quality too rapidly, and the drive linings can be exchanged without the aid of tools. Not even a partial dismantling of the drive-roller-body is necessary.

Other features which are considered as characteristic for the invention are set forth in the appended claims.

Although the invention is illustrated and described herein as embodied in a drive roller, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, partially cross-sectional view through the drive roller of a set of bobbins according to an embodiment of the invention; and FIG. 2 is a fragmentary, front-elevational view of the drive roller of FIG. 1 with the textile-spool resting upon it.

Referring now to the figures of the drawing as a whole, there is seen a central shaft 11 that leads from bobbin assembly to bobbin assembly of a winding frame which is not further shown in the drawings, the shaft being broken off in the figures. A drive-roller-body, which is designated as a whole with reference character 12, is fastened by a screw 13 on the central shaft 11. The drive-roller-body 12 includes three parts, manely a middle part 14, and two side parts 15 and 16. Drive-linings 17, 18 with high friction properties are disposed at the ends of the drive-roller in the invention. The middle part 14 is formfittingly clamped together with each of the two drive-linings 17, 18 by radial serrations provided at parting or separating joints 19, 20. In other words, the parts 14, 17 and 18 are shaped so as to fit together. During the winding operation, the thread cannot enter into these serrations.

The side parts 15, 16 of the drive-roller-body 12 are formed as pot-shaped, drawn sheetmetal parts which extend to the middlepart 14, and are each provided with a rolled edge 21, 22 at the end thereof which is in contact with the drive lining 17, 18. A parting joint 23, 24, is formed between each side part 15, 16 and the drive lining 17, 18, respectively, beyond the edge 25, 26, respectively, of the textile spool 27 which is to be wound.

In FIG. 1 it is seen that the pot-shaped side parts 15, 16 are secured to the middle part 14 by means of screws 28, 28'. The middle part 14 has annular edges 29, 30, into which the side parts are fitted. The side parts also serve as supports for the drive linings 17, 18, as can also be learned from FIG. 1. In FIG. 2 it is shown that the drive lining 17 has a parting-line 31 and the drive lining 18 has a parting-lining 32. These lines are pre-scored or pre-cut parting places, which do not have to be cut completely through on the new drive lining. However, when the drive lining is to be exchanged, the pre-fabricated parting line is completely cut through with a knife, and the drive lining is pried with a screw driver out of the serrations with the middlepart 14 and the rolled edge 21, 22. The installation of the replacement drive lining is effected in the reversed sequence, whereby the rubber-like elastic drive lining is first pressed behind the rolled edge 21, 22, and then pressed into the serrations, which requires no tools at all.

There is claimed:

1. Drive roller for winding a textile spool, comprising a drive-roller-body having a middle part and two separate side parts, and two removable, separable, annular drive linings with high friction properties, said side parts being in the form of pot-shaped, drawn sheetmetal parts being extended to said middle part and including a rolled edge integral with each side part, each edge being in contact with one of said drive linings for clamping one of said drive linings to each end of said drive-roller-body, and each of said drive linings having a portion with a shape being matched to the shape of portions of at least said middle part of said drive-roller-body.

2. Drive roller according to claim 1, wherein said drive linings and middle part have a radially directed serrated parting joint formed therebetween.

3. Drive roller according to claim 1, wherein each of said side parts partially overlaps one of said drive linings.

4. Drive roller according to claim 1, wherein said side parts and drive linings having parting joints formed therebetween beyond the textile spool to be wound.

* * * * *